US007588018B2

(12) United States Patent
Modien et al.

(10) Patent No.: US 7,588,018 B2
(45) Date of Patent: Sep. 15, 2009

(54) EXHAUST GAS RECIRCULATION COOLER BYPASS CARTRIDGE

(75) Inventors: Russell Miles Modien, Chatham (CA); Kenneth Peter Nydam, Chatham (CA)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 249 days.

(21) Appl. No.: 11/802,045

(22) Filed: May 18, 2007

(65) Prior Publication Data

US 2008/0289611 A1 Nov. 27, 2008

Related U.S. Application Data

(60) Provisional application No. 60/811,285, filed on Jun. 6, 2006.

(51) Int. Cl.
*F02B 47/08* (2006.01)
*F02B 47/00* (2006.01)

(52) U.S. Cl. ..... 123/568.12

(58) Field of Classification Search ..... 123/568.12, 123/568.17, 568.18, 568.11, 568.2, 189; 60/605.2

See application file for complete search history.

(56) References Cited

U.S. PATENT DOCUMENTS

| | | | | |
|---|---|---|---|---|
| 6,141,961 | A * | 11/2000 | Rinckel | 60/288 |
| 6,807,955 | B2 * | 10/2004 | Leedham et al. | 123/568.12 |
| 7,207,324 | B2 * | 4/2007 | Kuhnel et al. | 123/568.12 |
| 2003/0150434 | A1 * | 8/2003 | Leedham et al. | 123/568.12 |
| 2006/0174611 | A1 * | 8/2006 | Dilley et al. | 60/320 |
| 2007/0089407 | A1 * | 4/2007 | Smith et al. | 60/321 |
| 2008/0184974 | A1 * | 8/2008 | Kobayashi et al. | 123/568.12 |
| 2009/0007891 | A1 * | 1/2009 | Rollet | 123/568.12 |

FOREIGN PATENT DOCUMENTS

WO WO2005024220 * 3/2005

* cited by examiner

*Primary Examiner*—Mahmoud Gimie

(57) ABSTRACT

A bypass valve cartridge (10) is provided for permitting exhaust gas recirculation (EGR) flow to bypass a cooler port of a cooler of a vehicle. The cartridge (10) includes housing structure (11) constructed and arranged to be inserted into and mounted in a portion of a cooler (30). Flapper structure (22) is disposed in the housing structure and movable between a first position permitting EGR flow to pass to a cooler port (34) and a second position substantially preventing EGR flow to pass to the cooler port.

16 Claims, 6 Drawing Sheets

EXHAUST GAS RECIRCULATION COOLER BYPASS CARTRIDGE

This application claims the benefit of the earlier filing date of U.S. Provisional Application No. 60/811,285, filed on Jun. 6, 2006, which is incorporated by reference herein in its entirety.

FIELD OF THE INVENTION

The present invention relates to a cooler for use in an exhaust gas recirculation (EGR) system in an internal combustion engine and, more particularly to a bypass valve cartridge provided in the cooler.

BACKGROUND OF THE INVENTION

In general, when diesel fuel is burned in an engine, nitrogen oxides are produced in the exhaust gas. An EGR cooler provides a cooled dilutent to lower combustion temperatures and reduce the concentration of nitrogen oxides in the exhaust gases. Typically, when an engine is first started, a bypass valve, separate from the EGR cooler, is used to bypass the EGR cooler and redirect uncooled gasses through the engine to accelerate engine warmup. These bypass valves must withstand high temperature and are typically complicated, with an expensive, machined housing.

There is a need to provide an inexpensive and replaceable bypass valve for a EGR cooler.

SUMMARY OF THE INVENTION

An object of the invention is to fulfill the need referred to above. In accordance with the principles of the present invention a bypass valve cartridge is provided for permitting exhaust gas recirculation (EGR) flow to bypass a cooler port of a cooler of a vehicle. The cartridge includes housing structure constructed and arranged to be inserted into and mounted in a portion of a cooler. Flapper structure is disposed in the housing structure and is movable between a first position permitting EGR flow to pass to the cooler port and a second position substantially preventing EGR flow to pass to the cooler port.

In accordance with another aspect of the invention, a bypass valve cartridge and cooler combination includes a bypass valve cartridge having housing structure and flapper structure disposed in the housing structure and movable between first and second positions. The cooler cools exhaust gas recirculation (EGR) flow and includes surfaces defining an opening leading to an internal space in the cooler. The cooler has internal walls near the opening and in the internal space. The cartridge is removably disposed in the internal space of the cooler with the housing structure being coupled with certain internal walls so that an inlet port, a cooler flow port, and a bypass flow port are defined in the internal space. When the flapper structure is in the first position, EGR flow is permitted to pass from the inlet port to the cooler port, and when the flapper structure is in the second position, EGR flow is permitted to pass from the inlet port to the bypass flow port while being substantially prevented from passing to the cooler port.

In accordance with yet another aspect of the invention, a method provides a bypass valve cartridge in a cooler of a vehicle. A cooler is provided for cooling exhaust gas recirculation (EGR) flow. The cooler has surfaces defining an opening leading to an internal space in the cooler. The cooler has internal walls near the opening and in the internal space. A bypass valve cartridge has housing structure and flapper structure disposed in the housing structure and movable between first and second positions. The cartridge is inserted through the opening and into the internal space, with the housing structure being coupled with certain internal walls so that an inlet port, a cooler flow port, and a bypass flow port are defined in the internal space and so that movement of the flapper structure between the first and second positions controls the EGR flow from the inlet port through either the cooler flow port or the bypass flow port.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENTS

Figure 1:
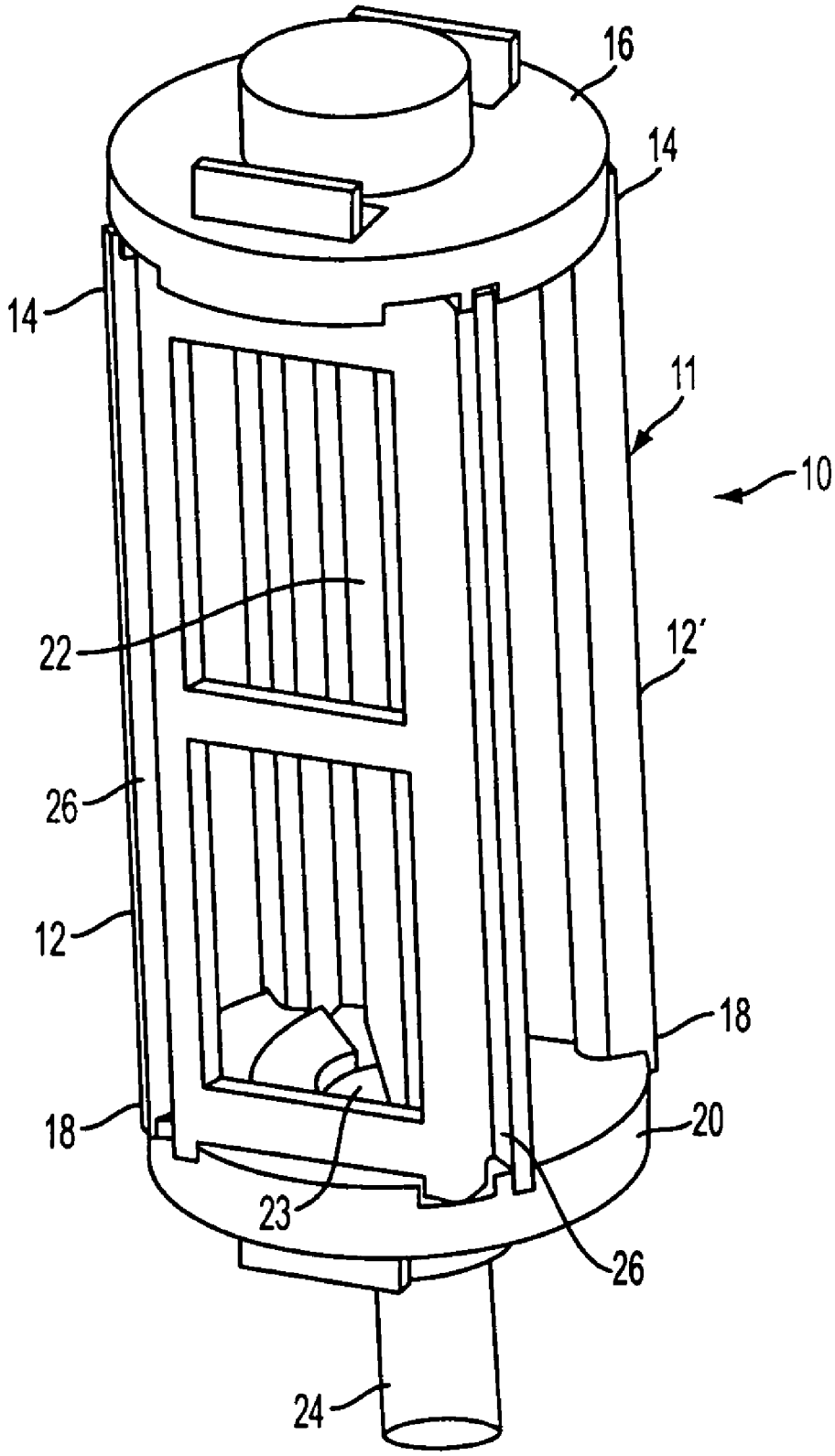
FIG. 1 is a front view of an EGR cooler bypass valve cartridge in accordance with an embodiment of the invention.
Figure 2:
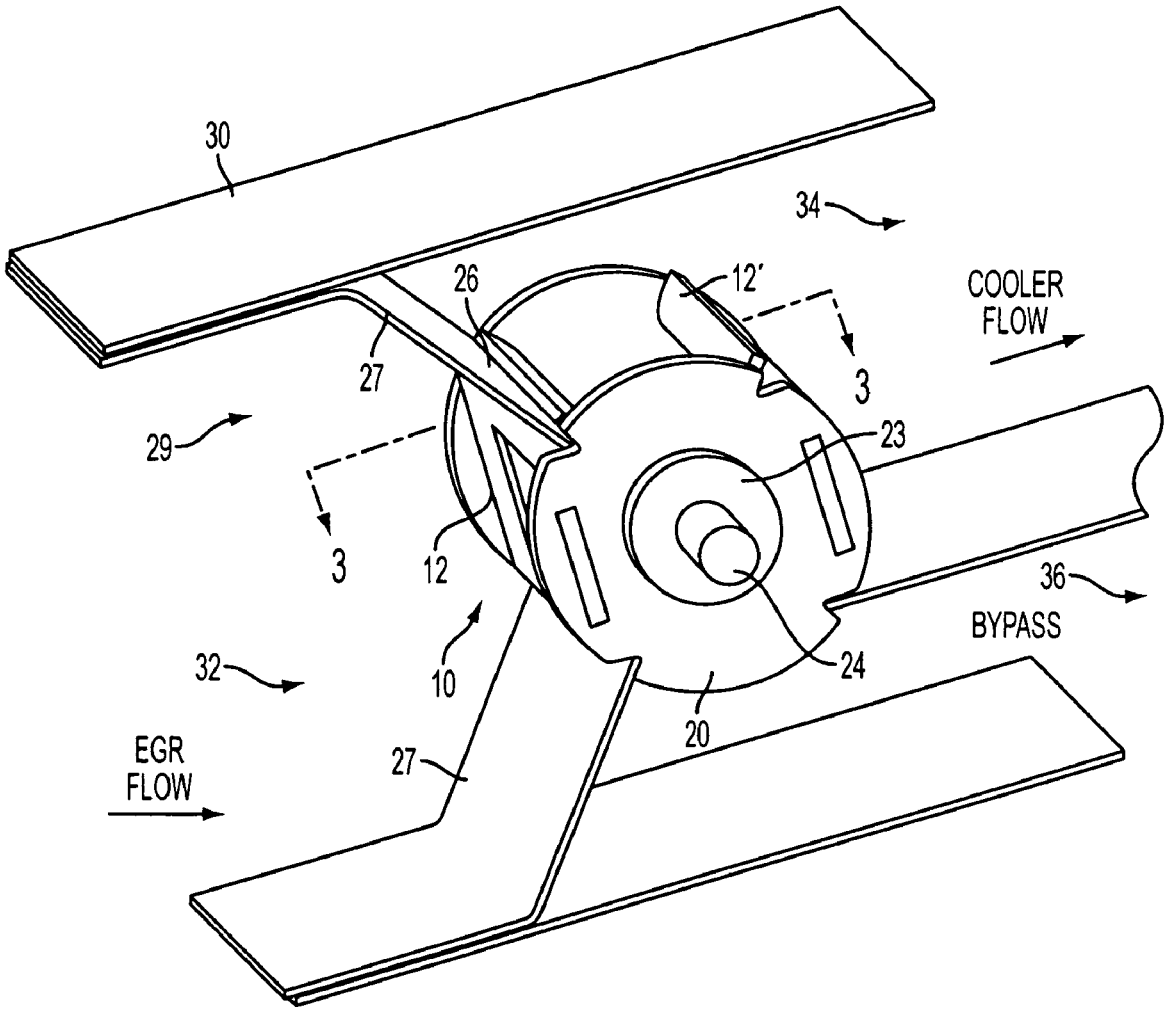
FIG. 2 is a view of the bypass valve cartridge of FIG. 1 shown mounted with respect to walls of a cooler.
Figure 3:
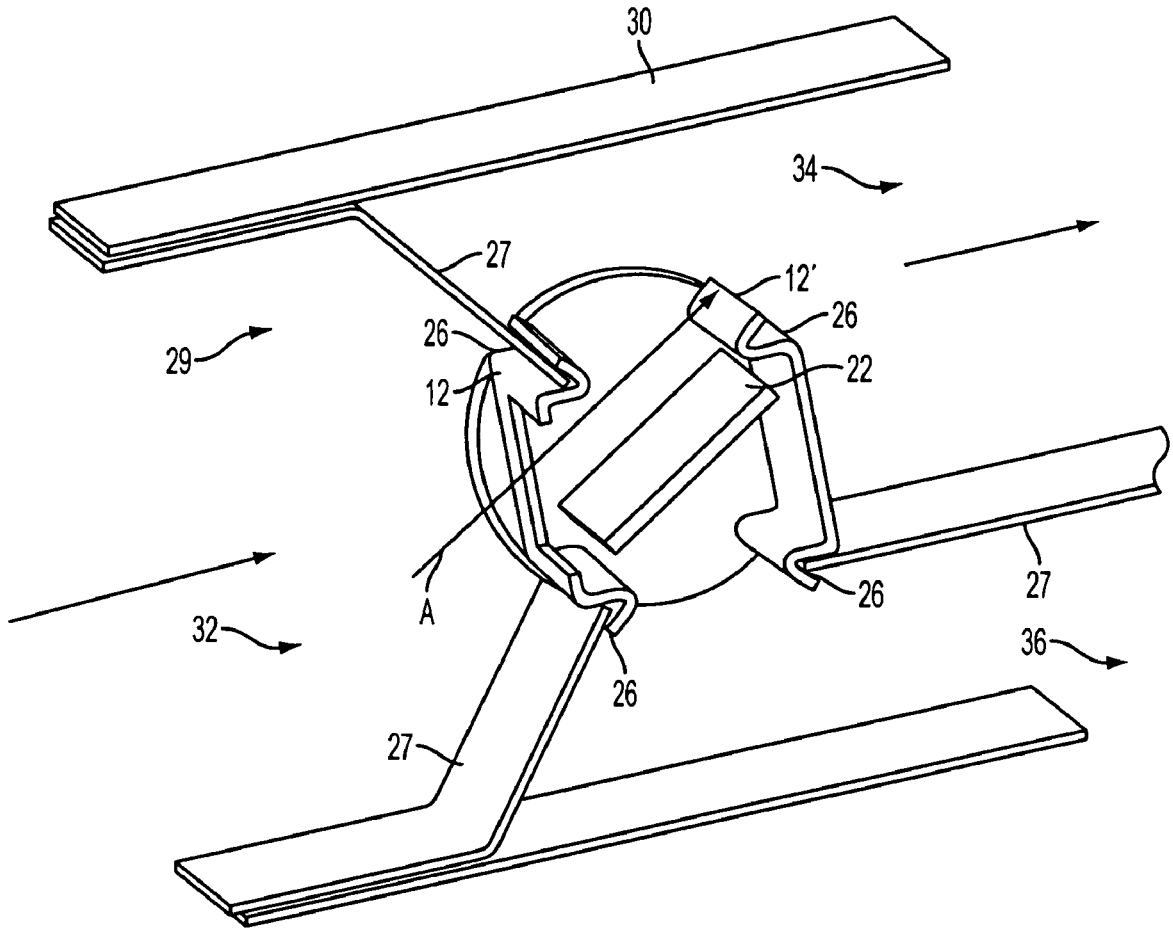
FIG. 3 is a partial sectional view of the cartridge taken along the line 3-3 in FIG. 2, showing flap structure in a cooling flow mode position.

With reference to FIGS. 1-3, an EGR cooler bypass valve cartridge is shown, generally indicated at 10, in accordance with an embodiment of the invention. The cartridge 10 includes a housing structure, generally indicated at 11. In the embodiment, the housing structure 11 includes a pair of housings 12, 12' disposed in spaced relation. As shown in FIG. 1, a first end 14 of housing 12, 12' is coupled with a first end cap 16 and a second end 18 of housing 12, 12' is coupled with a second end cap 20. The end caps 16 and 20 can be considered to be part of the housing structure 11.

The cartridge 10 also includes a flap structure 22 mounted for rotation between first and second positions, as will be explained more fully below. More particularly, the flap structure 22 is generally a flat plate structure that is supported by a bearing structure 23 at each end thereof. The flap structure 22 is coupled with a shaft 24 at one end thereof such that rotation of the shaft 24 rotates the flap structure 22. The housings 12, 12' and flap structure 22 are preferably stamped parts and the end caps 16, 20 are preferably made of sintered powdered metal. Thus, no complicated and expensive machining is required.

Figure 5:
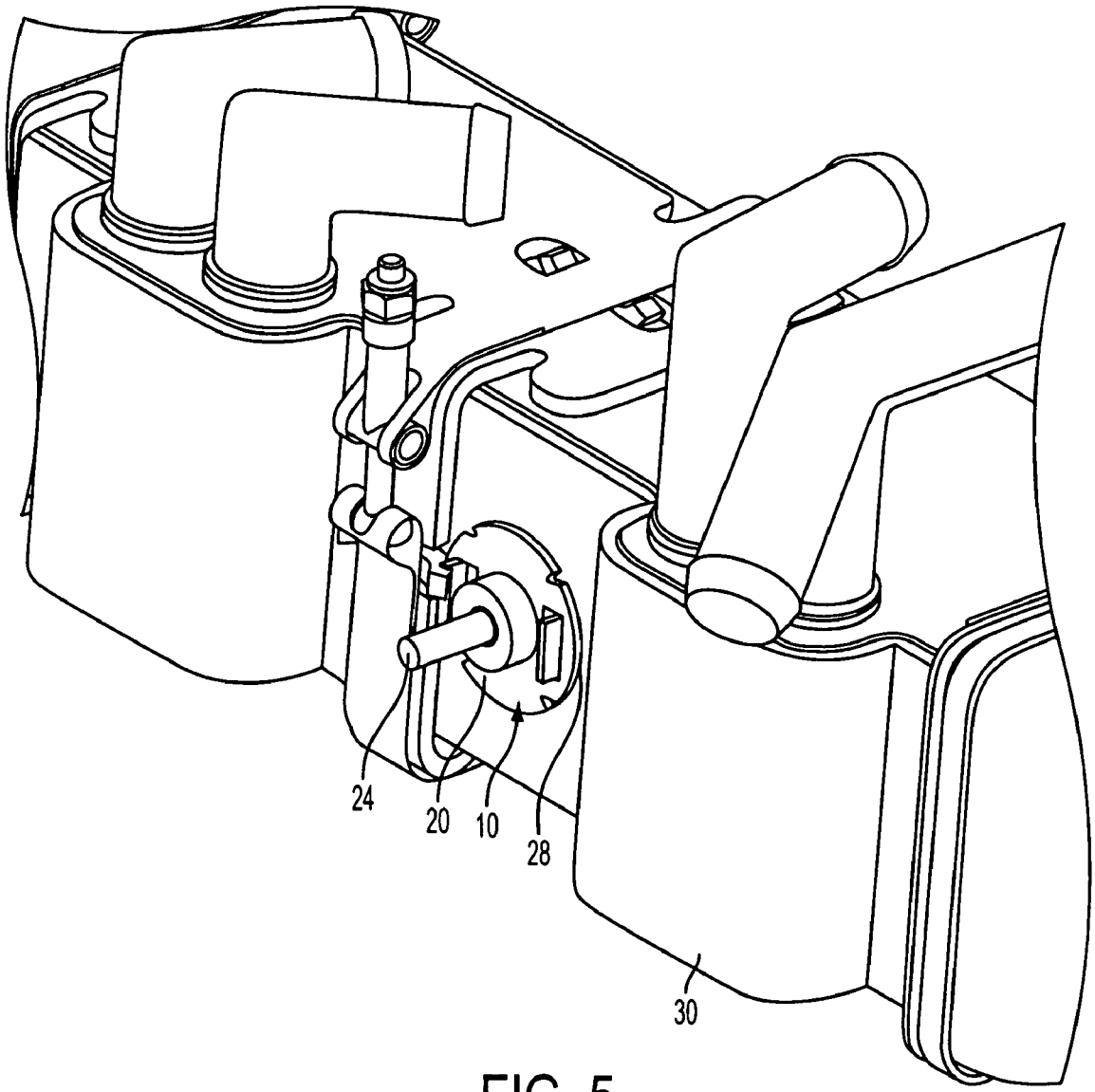
FIG. 5 is a view of a cooler having the cartridge of FIG. 1 installed therein.

With reference to FIGS. 2 and 3, each housing 12, 12' has a pair of longitudinally extending grooves 26 therein that receive internal walls 27 of a cooler. More particularly, with reference to FIG. 5, the cartridge 10 is received in an opening 28 leading to an internal space 29 (FIG. 2) in an EGR cooler 30. The internal walls 27 near the opening 28 are received in the grooves 26. The cartridge 10 is disposed in the opening 28 in a position that separates flow passages for cooled and un-cooled EGR flow. To reduce leakage, the cartridge 10 enters the cooler 30 from one side only and is held in place with a cover plate (not shown) and a gasket (not shown).

With reference to FIGS. 2 and 3, when the cartridge 10 is provided in the cooler 30, the internal walls 27 and cartridge 10 define an inlet port 32, a cooler port 34, and a bypass port 36 in the internal space 29. When the flap structure 22 is in the first position (FIG. 3) the cartridge 10 is in a cooling flow mode position where EGR flow (indicated by arrow A) is permitted to pass from the inlet port 32 to the cooler port 34 and be cooled by the cooler 30.

Figure 4:
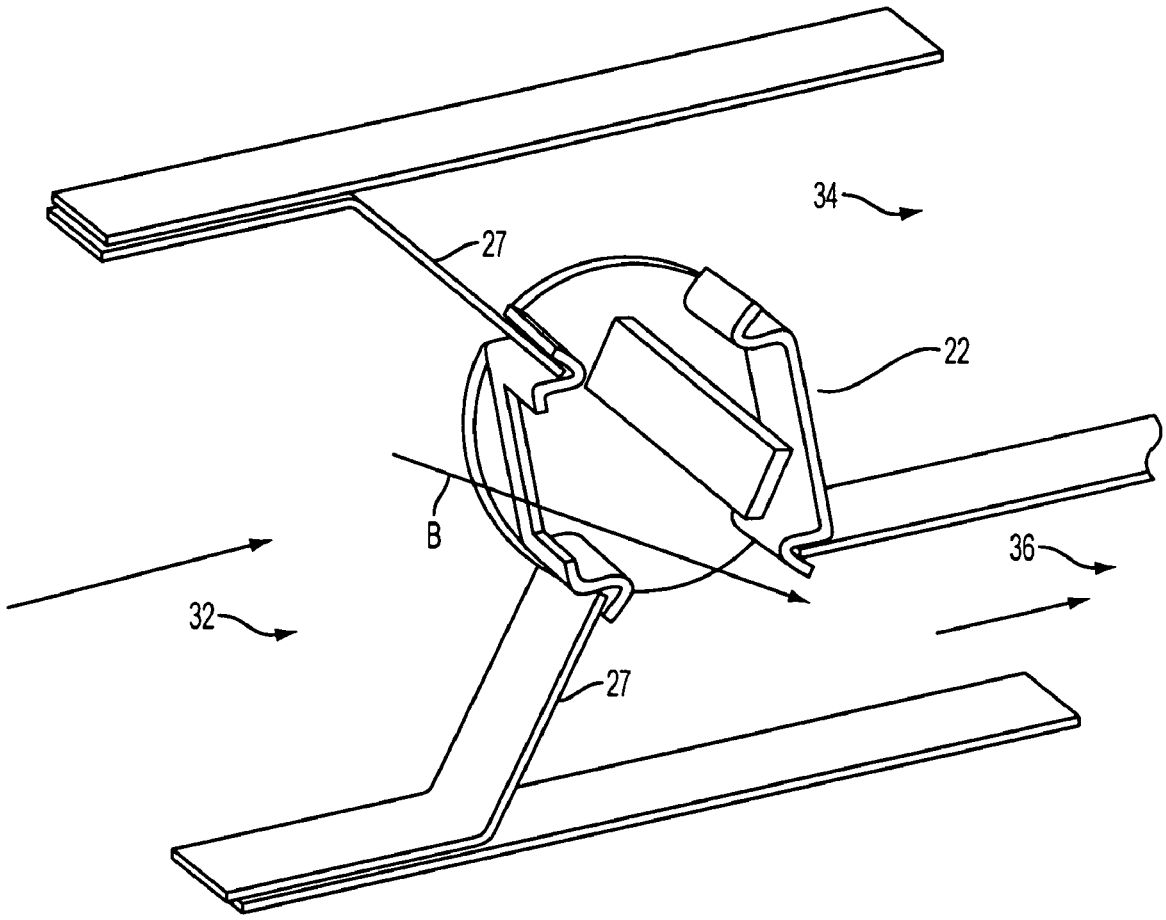
FIG. 4 is a sectional view of the cartridge showing the flap structure in a bypass flow mode position.

When the flap structure 22 is in the second position (FIG. 4) the cartridge 10 is in a bypass flow mode position where EGR flow (indicated by arrow B) is permitted to pass from the inlet port 32 to the bypass flow port 36 and bypass the cooler flow port 34 so that the high temperature bypass flow is sent to the intake manifold (not shown) of a vehicle. In particular, in the bypass flow mode position, EGR flow is substantially prevented from entering the cooler flow port 34.

The position of the flapper structure 22 is controlled by movement of the shaft 24 that is coupled to a motor (not shown). The motor can be controlled by an engine control unit.

Figure 6:
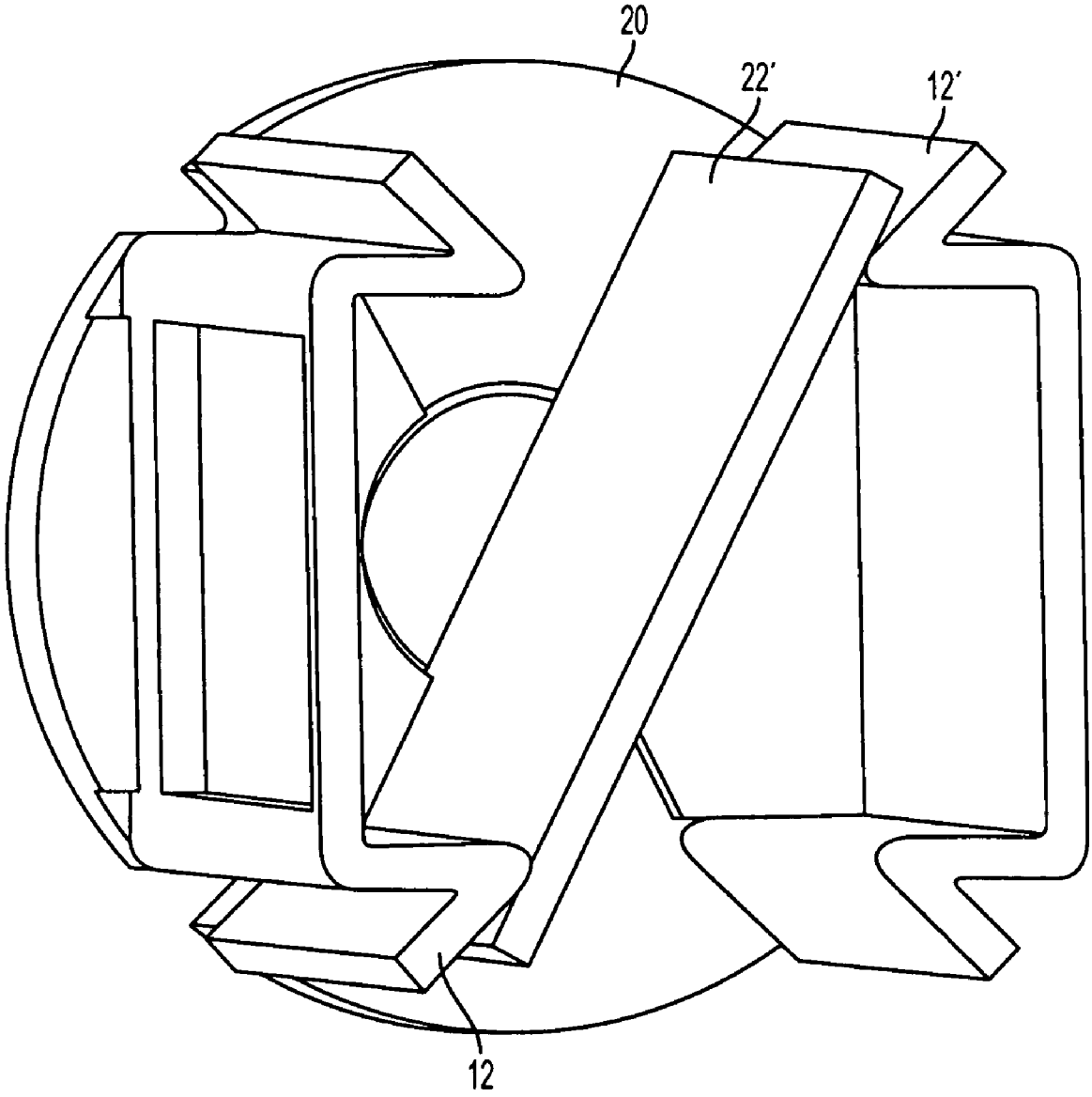
FIG. 6 is a sectional view of another embodiment of the flapper structure of the cartridge.

FIG. 6 shows another embodiment of the flapper structure 22'. Instead of the flapper structure 22 being within the bounds of the housings 12, 12', the flapper structure 22' can extend outside the bounds of the housings 12, 12'.

Thus, by using the replaceable cartridge 10, a defective cartridge can simply be removed and replaced. Further, since the cartridge 10 is not machined, the cost of an EGR bypass valve is reduced.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A bypass valve cartridge for permitting exhaust gas recirculation (EGR) flow to bypass a cooler port of a cooler of a vehicle, the cartridge comprising:

housing structure constructed and arranged to be inserted into and mounted in a portion of a cooler, and flapper structure disposed in the housing structure and movable between a first position permitting EGR flow to pass to a cooler port and a second position substantially preventing EGR flow to pass to the cooler port, wherein the housing structure includes longitudinally extending grooves in an exterior thereof constructed and arranged to receive internal walls of a cooler.

2. The cartridge of claim 1, wherein the housing structure comprises:

first and second housings disposed in spaced relation, each housing having first and second ends, and first and second end caps defining closed ends of the housing structure, the first end of each housing being coupled with the first end cap and the second end of each housing being coupled with the second end cap, and wherein the flapper structure has first and second ends, each flapper structure end being supported by a bearing structure disposed under an associated end cap.

3. The cartridge of claim 2, wherein each housing includes longitudinally extending grooves therein constructed and arranged to receive internal walls of a cooler.

4. The cartridge of claim 3, wherein the each housing includes a pair of grooves.

5. The cartridge of claim 1, wherein the flapper structure is in the form of a generally flat plate structure.

6. The cartridge of claim 1, wherein at least one end of the flapper structure is coupled with a shaft.

7. The cartridge of claim 1, in combination with the cooler, the cooler having internal walls, the housing structure being coupled with certain of the internal walls.

8. A bypass valve cartridge and cooler combination comprising:

a bypass valve cartridge comprising:

housing structure, and flapper structure disposed in the housing structure and movable between first and second positions, and a cooler, for cooling exhaust gas recirculation (EGR) flow, comprising:

surfaces defining an opening leading to an internal space in the cooler, and internal walls near the opening and in the internal space, the cartridge being removably disposed in the internal space of the cooler with the housing structure being coupled with certain internal walls so that an inlet port, a cooler flow port, and a bypass flow port are defined in the internal space, wherein when the flapper structure is in the first position, EGR flow is permitted to pass from the inlet port to the cooler port, and when the flapper structure is in the second position, EGR flow is permitted to pass from the inlet port to the bypass flow port while being substantially prevented from passing to the cooler port, wherein the housing structure includes longitudinally extending grooves in an exterior thereof receiving the certain internal walls of a cooler.

9. The combination of claim 8, wherein the housing structure comprises:

first and second housings disposed in spaced relation, each housing having first and second ends, and first and second end caps defining closed ends of the housing structure, the first end of each housing being coupled with the first end cap and the second end of each housing being coupled with the second end cap, and wherein the flapper structure has first and second ends, each flapper structure end being supported by a bearing structure disposed under an associated end cap.

10. The combination of claim 8, wherein the housing structure includes longitudinally extending grooves therein receiving the certain internal walls of a cooler.

11. The combination of claim 9, wherein the each housing includes a pair of grooves.

12. The combination of claim 8, wherein the flapper structure is in the form of a generally flat plate structure.

13. The combination of claim 8, wherein at least one end of the flapper structure is coupled with a shaft.

14. A method of providing a bypass valve cartridge in a cooler of a vehicle, the method comprising:

providing a cooler for cooling exhaust gas recirculation (EGR) flow, the cooler having surfaces defining an opening leading to an internal space in the cooler, the cooler having internal walls near the opening and in the internal space, providing a bypass valve cartridge having housing structure and flapper structure disposed in the housing structure and movable between first and second positions, and inserting the cartridge through the opening and into the internal space, with the housing structure being coupled with certain internal walls so that an inlet port, a cooler flow port, and a bypass flow port are defined in the internal space and so that movement of the flapper structure between the first and second positions controls the EGR flow from the inlet port through either the cooler flow port or the bypass flow port, wherein the housing structure includes longitudinally extending grooves in an exterior thereof, the inserting step including receiving the certain internal walls of the cooler in the grooves.

15. The method of claim 14, wherein the step of providing housing structure provides first and second housings disposed in spaced relation, each housing having first and second ends, and first and second end caps defining closed ends of the housing structure, the first end of each housing being coupled with the first end cap and the second end of each housing being coupled with the second end cap, and wherein the flapper structure has first and second ends, each flapper structure end being supported by a bearing structure disposed under an associated end cap.

16. The method of claim 15, wherein each housing includes longitudinally extending grooves, the inserting step including receiving the certain internal walls of a cooler in the grooves.

* * * * *